US010884446B2

(12) United States Patent
Shreepathi Bhat

(10) Patent No.: US 10,884,446 B2
(45) Date of Patent: Jan. 5, 2021

(54) CURRENT REFERENCE CIRCUIT

(71) Applicant: TEXAS INSTRUMENTS INCORPORATED, Dallas, TX (US)

(72) Inventor: Avinash Shreepathi Bhat, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 16/550,986

(22) Filed: Aug. 26, 2019

(65) Prior Publication Data

US 2020/0264647 A1 Aug. 20, 2020

Related U.S. Application Data

(60) Provisional application No. 62/807,168, filed on Feb. 18, 2019.

(51) Int. Cl.
*G05F 3/26* (2006.01)
*G05F 3/16* (2006.01)

(52) U.S. Cl.
CPC ..... *G05F 3/262* (2013.01); *G05F 3/16* (2013.01); *G05F 3/267* (2013.01)

(58) Field of Classification Search
CPC ..... H02M 2001/0025; H02M 3/156; H02M 3/158; H02M 3/1588; H02M 3/155; H02M 3/1582; H02M 3/157; H02M 3/1563; H02M 3/1584; G05F 3/26; G05F 3/262; G05F 3/265; G05F 3/267; G05F 3/02; G05F 3/30; G05F 3/22; G05F 3/222; G05F 3/242; G05F 3/225; G05F 3/245; G05F 3/20; G05F 3/00; G05F 3/08; G05F 3/10; G05F 3/16; G05F 3/18; G05F 3/185; G05F 3/227; G05F 3/247; G05F 3/24; H03F 3/45174
USPC ..... 323/288, 271, 282, 284–285, 311–313, 323/315
See application file for complete search history.

(56) References Cited

U.S. PATENT DOCUMENTS 6,294,902 B1 * 9/2001 Moreland ..... G05F 3/30 323/268
2013/0328542 A1 * 12/2013 Wang ..... G05F 3/245 323/313
2015/0349637 A1 * 12/2015 Lu ..... H02M 3/158 323/271

* cited by examiner

*Primary Examiner* — Bryan R Perez
(74) *Attorney, Agent, or Firm* — Lawrence J. Bassuk; Charles A. Brill; Frank D. Cimino

(57) ABSTRACT

A current reference circuit includes a native metal oxide semiconductor field effect transistor (MOSFET). The native MOSFET includes a source terminal coupled to ground. The current reference circuit also includes a transistor and an amplifier circuit. The transistor includes a first terminal coupled to a drain terminal of the native MOSFET, a second terminal coupled to a power supply rail, and a third terminal coupled to the drain terminal of the native MOSFET. The amplifier circuit includes an input terminal coupled to the drain terminal of the native MOSFET, and an output terminal coupled to a gate terminal of the native MOSFET.

15 Claims, 7 Drawing Sheets

CURRENT REFERENCE CIRCUIT

CROSS-REFERENCE TO RELATED APPLICATIONS

The present application claims priority to U.S. Provisional Patent Application No. 62/807,168, filed Feb. 18, 2019, entitled "Apparatus for Ultra Low Power Applications with Accurate Current Reference in a Start-up-less Environment," which is hereby incorporated herein by reference in its entirety.

BACKGROUND

Current reference circuits are used in analog integrated circuits to provide an accurate reference current from which bias currents are derived. The bias currents may be supplied to various analog circuits such as amplifiers, current controlled oscillators, etc. The reference current should have a well-defined temperature coefficient and be independent of power supply voltage.

SUMMARY

Current reference circuits that include native transistor current mirrors and a negative feedback amplifier are disclosed herein. In one example, a current reference circuit includes a native metal oxide semiconductor field effect transistor (MOSFET). The native MOSFET includes a source terminal coupled to ground. The current reference circuit also includes a transistor and an amplifier circuit. The transistor includes a first terminal coupled to a drain terminal of the native MOSFET, a second terminal coupled to a power supply rail, and a third terminal coupled to the drain terminal of the native MOSFET. The amplifier circuit includes an input terminal coupled to the drain terminal of the native MOSFET, and an output terminal coupled to a gate terminal of the native MOSFET.

In another example, a current reference circuit includes a transistor coupled to a power rail and connected as a diode. The current reference circuit also includes a native MOSFET and an amplifier circuit. The native MOSFET is coupled to a current output terminal of the transistor, and is configured to initiate flow of a reference current through the transistor and the native MOSFET. The amplifier circuit is coupled to the native MOSFET and the transistor, and is configured to generate a bias voltage at a gate terminal of the native MOSFET based on a voltage at a drain terminal of the native MOSFET.

In a further example, a system includes an analog circuit and a current reference. The current reference circuit is coupled to the analog circuit. The current reference circuit includes a first native MOSFET, a second native MOSFET, and an amplifier circuit. The second native MOSFET includes a gate terminal coupled to a gate terminal of the first native MOSFET, and a source terminal coupled to a source terminal of the first native MOSFET. The amplifier circuit includes a first input coupled to a drain terminal of the first native MOSFET, a second input coupled to a drain terminal of the second native MOSFET, and an output coupled to the gate terminal of the first native MOSFET and the gate terminal of the second MOSFET.

BRIEF DESCRIPTION OF THE DRAWINGS

For a detailed description of various examples, reference will now be made to the accompanying drawings in which.

DETAILED DESCRIPTION

The term "couple" is used throughout the specification. The term may cover connections, communications, or signal paths that enable a functional relationship consistent with the description of the present disclosure. For example, if device A generates a signal to control device B to perform an action, in a first example device A is coupled to device B, or in a second example device A is coupled to device B through intervening component C if intervening component C does not substantially alter the functional relationship between device A and device B such that device B is controlled by device A via the control signal generated by device A. Also, in this description, the recitation "based on" means "based at least in part on." Therefore, if X is based on Y, then X may be a function of Y and any number of other factors.

High accuracy current reference circuits have two stable operating states. In a first stable operating state, the current reference circuit is off, and the reference current generated by the circuit is zero. In a second stable operating state, the current reference circuit is on, and generates a predetermined non-zero reference current. Start-up circuitry is coupled to the current reference circuit to induce current flow and ensure that the current reference circuit settles in the on state. The start-up circuitry increases overall circuit size and consumes current, which increases the power consumption of low-power systems.

Figure 1:
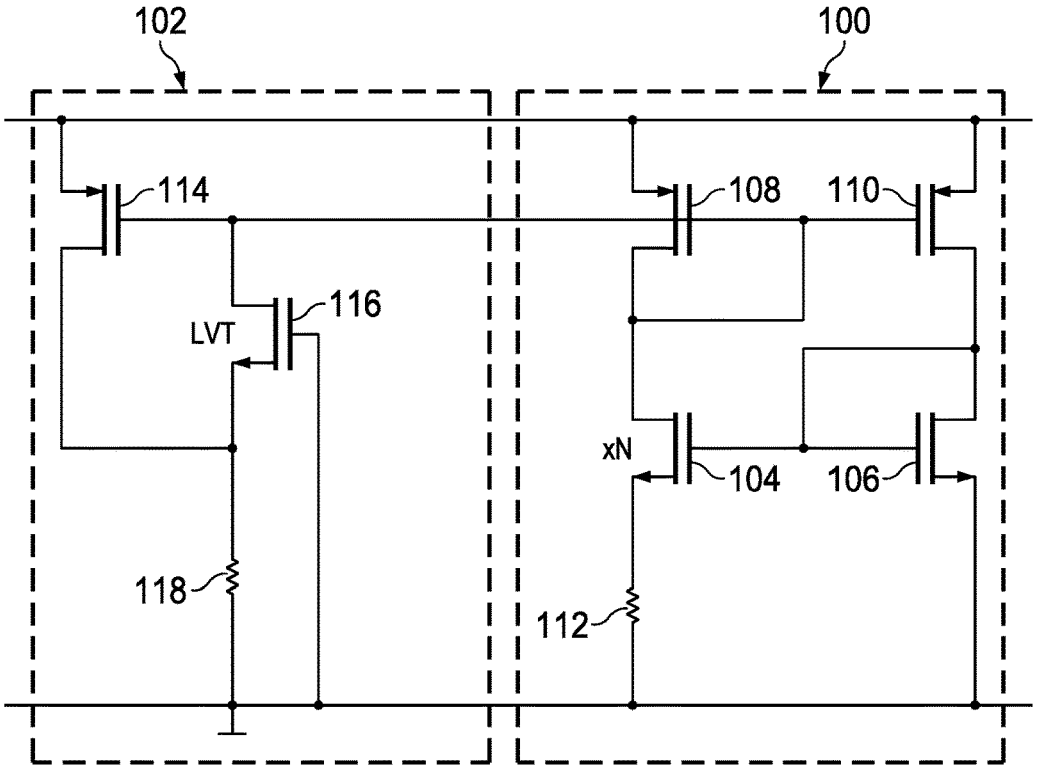
FIG. 1 shows a schematic diagram for a current reference circuit that includes start-up circuitry.

FIG. 1 shows a schematic diagram for a current reference circuit 100 coupled to start-up circuitry 102. The current reference circuit 100 includes transistors 104, 106, 108, and 110 and resistor 112 connected as a beta-multiplier current reference. The reference current generated by the current reference circuit 100 is defined as:

$$I_{REF} = \frac{\Delta V_{GS}}{R_{BIAS}},$$

where:

$\Delta V_{GS}$ is the difference of the gate source voltage of the transistors 104 and 106; and $R_{BIAS}$ is the resistance of the resistor 112.

The start-up circuitry 102 includes transistors 114 and 116, and resistor 118. The transistor 116 is a low threshold voltage transistor. For example, the transistor 106 may turn on at a threshold of about 0.3 volts, while the transistor 114 (and the transistors 104, 106, 108, and 110) may turn on at a higher threshold (e.g., about 0.7 volts). The low threshold of the transistor 116 allows a leakage current to flow in the transistor 116, which produces sufficient gate-source voltage across the transistors 108 and 110 to turn on the current reference circuit 100.

In some implementations of the current reference circuit 100, the transistors 104 and 106 may be bipolar NPN transistors to produce an accurate PTAT reference current given by:

$$I_{REF} = \frac{\Delta V_{BE}}{R_{BIAS}}.$$

Figure 2:
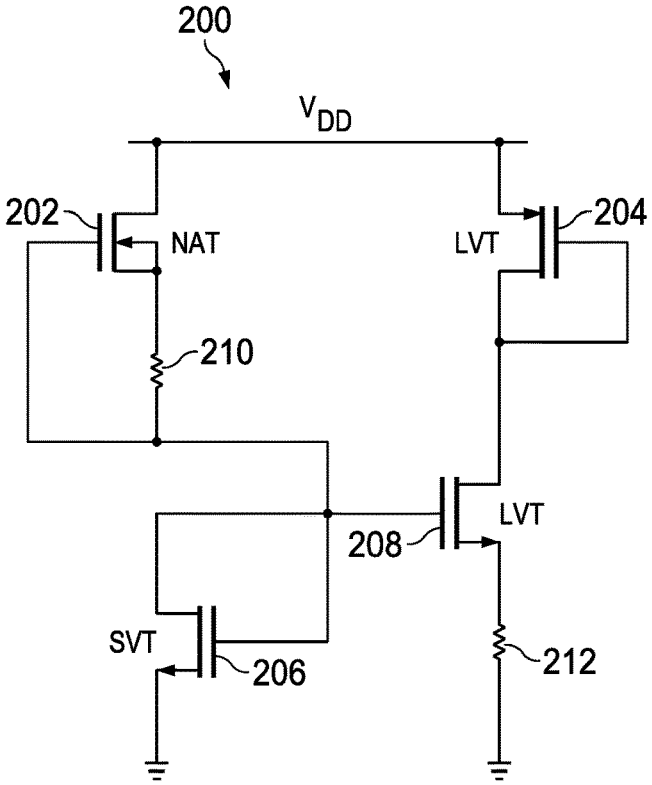
FIG. 2 shows a schematic diagram for a self-starting current reference circuit.

Some current reference circuits need no start-up circuitry. FIG. 2 shows a schematic diagram for a self-starting current reference circuit 200. The current reference circuit 200 includes 202-208 and resistors 210 and 212. The transistor 206 has a standard threshold voltage (e.g., the transistor 206 turns on at about 0.7 volts), the transistors 204 and 208 have a low threshold voltage (e.g., the transistors 204 and 208 turn on at about 0.3 volts). The transistor 202 is a native MOSFET. A native MOSFET is produced without channel implantation to adjust the threshold voltage, and therefore has a threshold voltage near zero volts. That is, the threshold voltage of the transistor 202 is lower than threshold voltage of the transistor 204 and the transistor 208. The reference current generated by the current reference circuit 200 is defined as:

$$I_{REF} = \Delta V_{th_SVT-LVT_NMOS} + \frac{mV_T \ln\left(\frac{\beta_{LVTNMOS}}{\beta_{SVTNMOS}}\right)}{R}$$

where:

$\Delta V_{th_SVT-LVT_NMOS}$ is the difference in the threshold voltages of the transistors 106 and 108;

m is slope factor;

$V_T$ is thermal voltage;

$\beta_{LVTNMOS}$ is gain of the 104;

$\beta_{LVTNMOS}$ is gain of the 108; and

R is the resistance of the resistor 112.

As the current reference circuit 200 is powered up, current flows in the transistor 202 which triggers flows of the reference current in the transistor 104 and the transistor 108. While the current reference circuit 200 does not require start-up circuitry, the accuracy of the current reference circuit 200 is a function of the thresholds of the transistor 106 and the transistor 108. Thus, the accuracy of the current reference circuit 200, and the reference current generated by the current reference circuit 200, cay vary substantially with the difference in the thresholds of the transistor 106 and the transistor 108.

FIGS. 3-7 show schematic diagrams for current reference circuits in accordance with this description. The current reference circuits of FIGS. 3-7 include no start-up circuitry and provide accurate reference currents. Omission of start-up circuitry makes the current reference circuits area efficient and suitable for use in ultra-low power applications (e.g., battery powered applications with nano-ampere current draw). For example, the circuit area and current consumption of the current reference circuits of FIGS. 3-7 may be lower and the reference current accuracy higher than is provided by the current reference circuits of FIG. 1 or 2.

Figure 3:
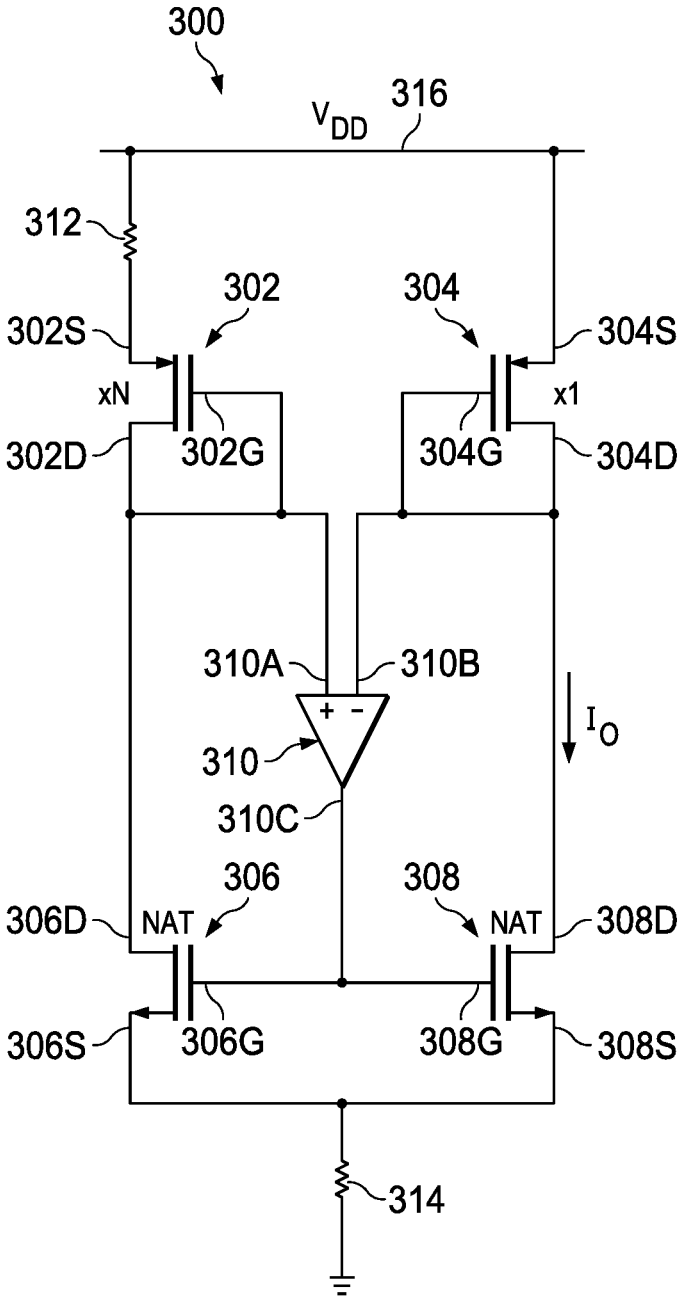
FIGS. 3-7 show schematic diagrams for current reference circuits in accordance with this description.

FIG. 3 shows a current reference circuit 300 that includes native transistor current mirrors and a negative feedback amplifier to generate a reference current. The current reference circuit 300 includes transistors 302-308, an amplifier circuit 310, and resistors 312 and 314. The transistor 302 and the transistor 304 have a standard (e.g., 0.7 volt) threshold. In this implementation of the current reference circuit 300, the transistor 302 and the transistor 304 are P-channel MOSFETs, and the transistor 306 and the transistor 308 are N-channel native MOSFETs. The transistor 302 may be larger (N times larger) than the transistor 304. The amplifier circuit 310 applies feedback from the drains of the native MOSFET 304 and the native MOSFET 308 to control the native MOSFET 306 and the native MOSFET 308. When power is applied to the current reference circuit 300, the power supply rail 316 rises, and the drain current of the native MOSFET 306 rises, thereby causing the current reference circuit 300 to settle in the on state. The reference current (Jo) generated by the current reference circuit 300 flows through the native MOSFET 308.

The native MOSFET 308 includes a source terminal 308S that is coupled to the source terminal 306S of the native MOSFET 306, and to the resistor 314. The gate terminal 308G of the native MOSFET 308 is coupled to the gate terminal 306G of the native MOSFET 306 and the output terminal 310C of the amplifier circuit 310. The drain terminal 308D of the native MOSFET 308 is coupled to the drain terminal 304D of the transistor 304, and to the input terminal 310B of the amplifier circuit 310. The drain terminal 306D of the native MOSFET 306 is coupled to the drain terminal 302D of the transistor 302, and to the input terminal 310A of the amplifier circuit 310.

The transistor 304 is connected as a diode, with the gate terminal 304G is of the transistor 304 coupled to the drain terminal 304D of the transistor 304. The source terminal 304S of the transistor 304 is coupled to the power supply rail 316. The transistor 302 is also connected as a diode, with the gate terminal 302G of the transistor 302 coupled to the drain terminal 302D of the transistor 302. The source terminal 302S of the transistor 302 is coupled to the power supply rail 316 via the resistor 312.

Figure 4:
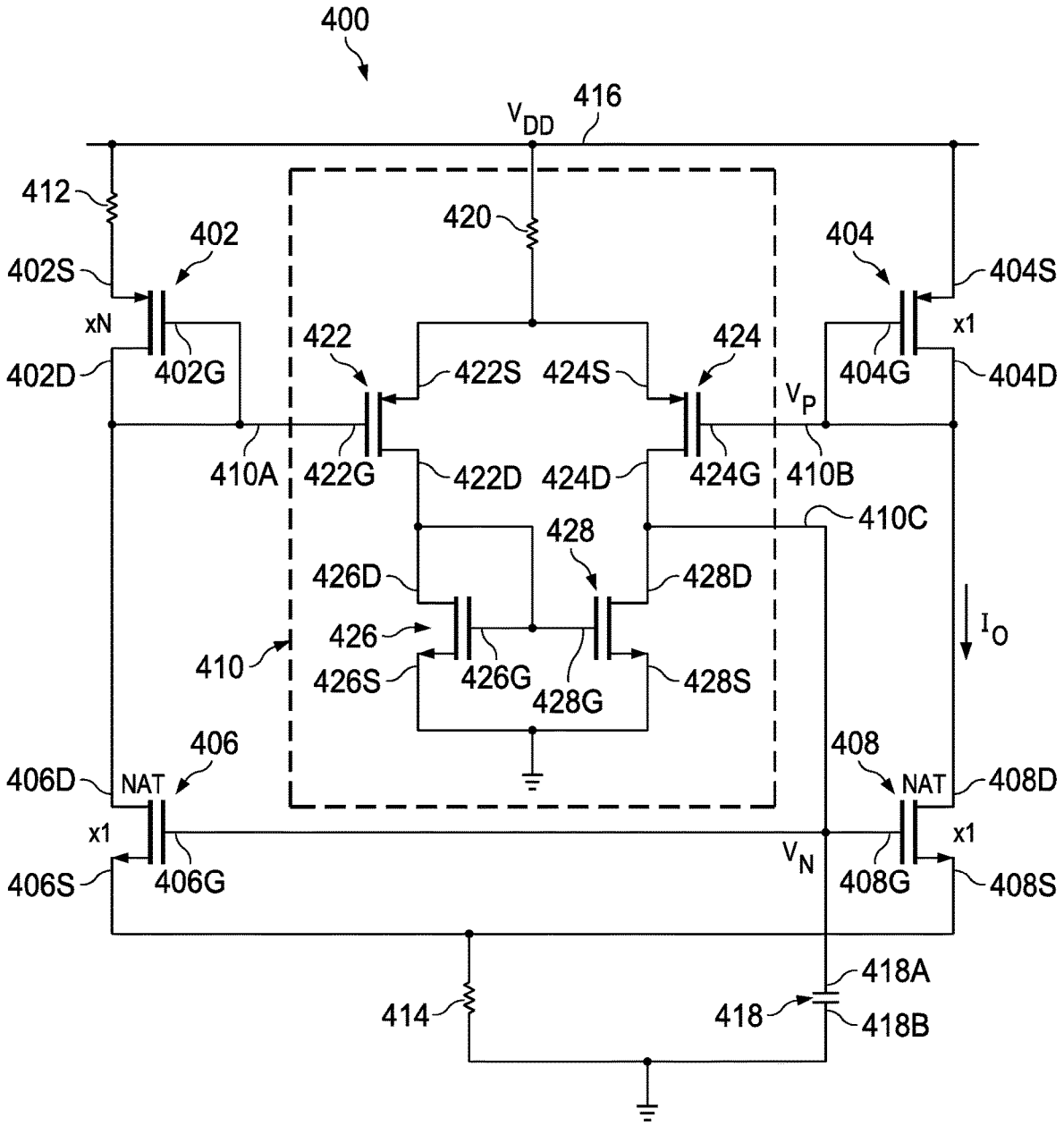

FIG. 4 shows a current reference circuit 400 that includes native transistor current mirrors and a negative feedback amplifier to generate a reference current. The current reference circuit 400 is an implementation of the current reference circuit 300. The current reference circuit 400 includes transistors 402-408, an amplifier circuit 410, resistors 412 and 414, and a capacitor 418. The transistor 402 and the transistor 404 have a standard (e.g., 0.7 volt) threshold. The transistor 402 and the transistor 404 are P-channel MOSFETs, and the transistor 406 and the transistor 408 are N-channel native MOSFETs. The transistor 402 may be larger (N times larger) than the transistor 404. The amplifier circuit 410 applies feedback from the drains of the transistor 404 and the native MOSFET 408 to generate a bias voltage at the gate terminals of the native MOSFETs 406 and 408. When power is applied to the current reference circuit 400, the power supply rail 416 rises, and the drain current of the native MOSFET 406 rises, thereby causing the current reference circuit 400 to settle in the on state. The reference current generated by the current reference circuit 400 flows through the native MOSFET 408.

The native MOSFET 408 includes a source terminal 408S that is coupled to the source terminal 406S of the native MOSFET 406, and to the resistor 414. The gate terminal 408G of the native MOSFET 408 is coupled to the gate terminal 406G of the native MOSFET 406 and the output terminal 410C of the amplifier circuit 410. The drain terminal 408D of the native MOSFET 408 is coupled to the drain terminal 404D of the transistor 404, and to the input terminal 410B of the amplifier circuit 410. The drain terminal 406D of the native MOSFET 406 is coupled to the drain terminal (the current output terminal) 402D of the transistor 402, and to the input terminal 410A of the amplifier circuit 410.

The transistor 404 is connected as a diode, with the gate terminal 404G of the transistor 404 coupled to the drain terminal 404D of the transistor 404. The source terminal 404S of the transistor 404 is coupled to the power supply rail 416. The transistor 402 is also connected as a diode, with the gate terminal 402G of the transistor 402 coupled to the drain terminal 402D of the transistor 402. The source terminal 402S of the transistor 402 is coupled to the power supply rail 416 via the resistor 412. The capacitor 418 is a compensation capacitor that includes a terminal 418A coupled to the output terminal 410C of the amplifier circuit 410, and a terminal 418B coupled to ground.

The amplifier circuit 410 is an implementation of the amplifier circuit 310. The amplifier circuit 410 includes a transistor 422, a transistor 424, a transistor 426, a transistor 428, and a resistor 420. The transistor 422 and the transistor 424 are P-channel MOSFETs, and the transistor 426 and the transistor 428 are N-channel MOSFETs. The transistor 422 includes a source terminal 422S that is coupled to the source terminal 424S of the transistor 424, and to the power supply rail 416 via the resistor 420. The gate terminal 422G of the transistor 422 serves as the input terminal 410A of the amplifier circuit 410. The drain terminal 422D of the transistor 422 is coupled to the drain terminal 426D of the transistor 426. The transistor 426 is connected as a diode, with the 426D coupled to the gate terminal 426G. the source terminal 426S of the transistor 426 is coupled to ground.

The gate terminal 424G of the transistor 424 serves as the input terminal 410B of the amplifier circuit 410. The drain terminal 424D of the transistor 424 is coupled to the drain terminal 428D of the transistor 428. The drain terminal 428D serves as the output terminal 410C of the amplifier circuit 410. The gate terminal 428G is coupled to the gate terminal 426G of the transistor 426, and the source terminal 428S of the transistor 428 is coupled to ground.

Figure 5:
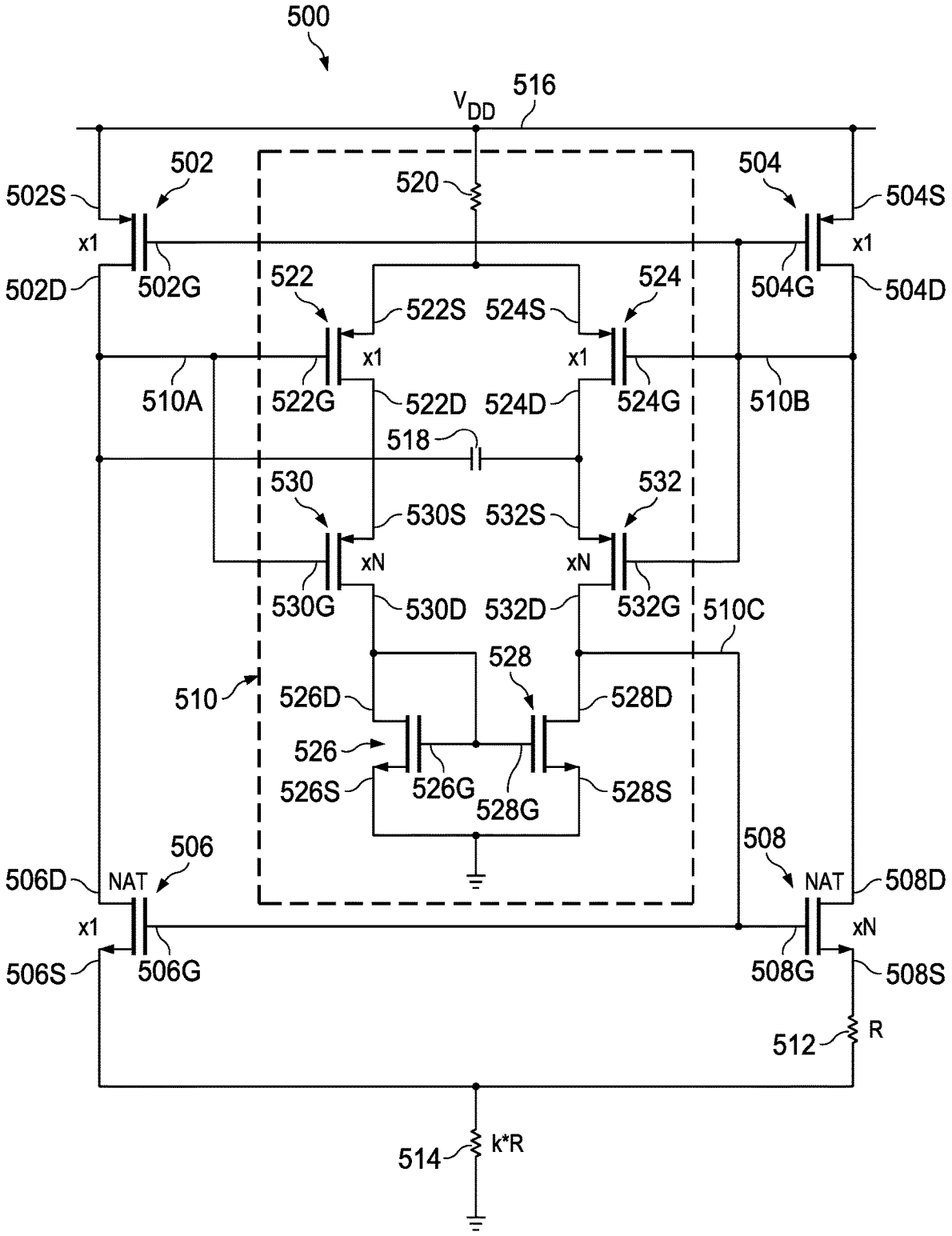

FIG. 5 shows a current reference circuit 500 that includes native transistor current mirrors and a negative feedback amplifier to generate a reference current. The current reference circuit 500 is an implementation of the current reference circuit 300. The current reference circuit 500 includes transistors 502-508, an amplifier circuit 510, and resistors 512 and 514, and capacitor 518. The transistor 502 and the transistor 504 have a standard (e.g., 0.7 volt) threshold. The transistor 502 and the transistor 504 are P-channel MOSFETs, and the transistor 506 and the transistor 508 are N-channel native MOSFETs. The native MOSFET 508 may be larger (N times larger) than the native MOSFET 506. The amplifier circuit 510 applies feedback from the drains of the transistor 504 and the native MOSFET 508 to control the native MOSFET 506 and the native MOSFET 508. When power is applied to the current reference circuit 500, the power supply rail 516 rises, and the drain current of the native MOSFET 506 rises causing the current reference circuit 500 to settle in the on state. The reference current generated by the current reference circuit 500 flows through the native MOSFET 508.

The native MOSFET 506 includes a source terminal 506S that is coupled to the source terminal 508S of the native MOSFET 508 via the resistor 512. The source terminal 506S of the native MOSFET 506 and the resistor 512 are coupled to ground via the resistor 514. The gate terminal 508G of the native MOSFET 508 is coupled to the gate terminal 506G of the native MOSFET 506 and the output terminal 510C of the amplifier circuit 510. The drain terminal 508D of the native MOSFET 508 is coupled to the drain terminal 504D of the transistor 504, and to the input terminal 5106 of the amplifier circuit 510. The drain terminal 506D of the native MOSFET 506 is coupled to the drain terminal 502D of the transistor 502, and to the input terminal 510A of the amplifier circuit 510.

The transistor 504 is connected as a diode, with the gate terminal 504G of the transistor 504 coupled to the drain terminal 504D of the transistor 504. The source terminal 504S of the transistor 504 is coupled to the power supply rail 516. The gate terminal 502G of the transistor 502 is coupled to the gate terminal 504G of the transistor 504. The source terminal 502S of the transistor 502 is coupled to the power supply rail 516.

The amplifier circuit 510 is an implementation of the amplifier circuit 310. The amplifier circuit 510 includes a transistor 522, a transistor 524, a transistor 526, a transistor 528, a transistor 530, a transistor 532, a capacitor 518, and a resistor 520. The transistor 522, the transistor 524, the transistor 530, and the transistor 532 are P-channel MOSFETs, and the transistor 526 and the transistor 528 are N-channel MOSFETs. The transistor 522 includes a source terminal 522S that is coupled to the source terminal 524S of the transistor 524, and to the power supply rail 516 via the resistor 520. The gate terminal 522G of the transistor 522 serves as the input terminal 510A of the amplifier circuit 510. The drain terminal 522D of the transistor 522 is coupled to the source terminal 530S of the transistor 530. The gate terminal 530G of the transistor 530 is coupled to the gate terminal 522G of the transistor 522. The drain terminal 530D of the transistor 530 is coupled to the drain terminal 526D of the transistor 526. The transistor 526 is connected as a diode, with the drain terminal 526D coupled to the gate terminal 526G. The source terminal 526S of the transistor 526 is coupled to ground.

The gate terminal 524G of the transistor 524 serves as the input terminal 5106 of the amplifier circuit 510. The drain terminal 524D of the transistor 524 is coupled to the source terminal 532S of the transistor 532. The gate terminal of the transistor 532 is coupled to the gate terminal 524G of the transistor 524. The drain terminal 532D of the transistor 532 is coupled to the drain terminal 528D of the transistor 528. The drain terminal 528D serves as the output terminal 510C of the amplifier circuit 510. The gate terminal 528G of the transistor 528 is coupled to the gate terminal 526G of the transistor 526, and the source terminal 528S of the transistor 528 is coupled to ground.

The capacitor 518 is a compensation capacitor that couples the drain terminal 524D of the transistor 524 to the input terminal 510A of the amplifier circuit 510.

Figure 6:
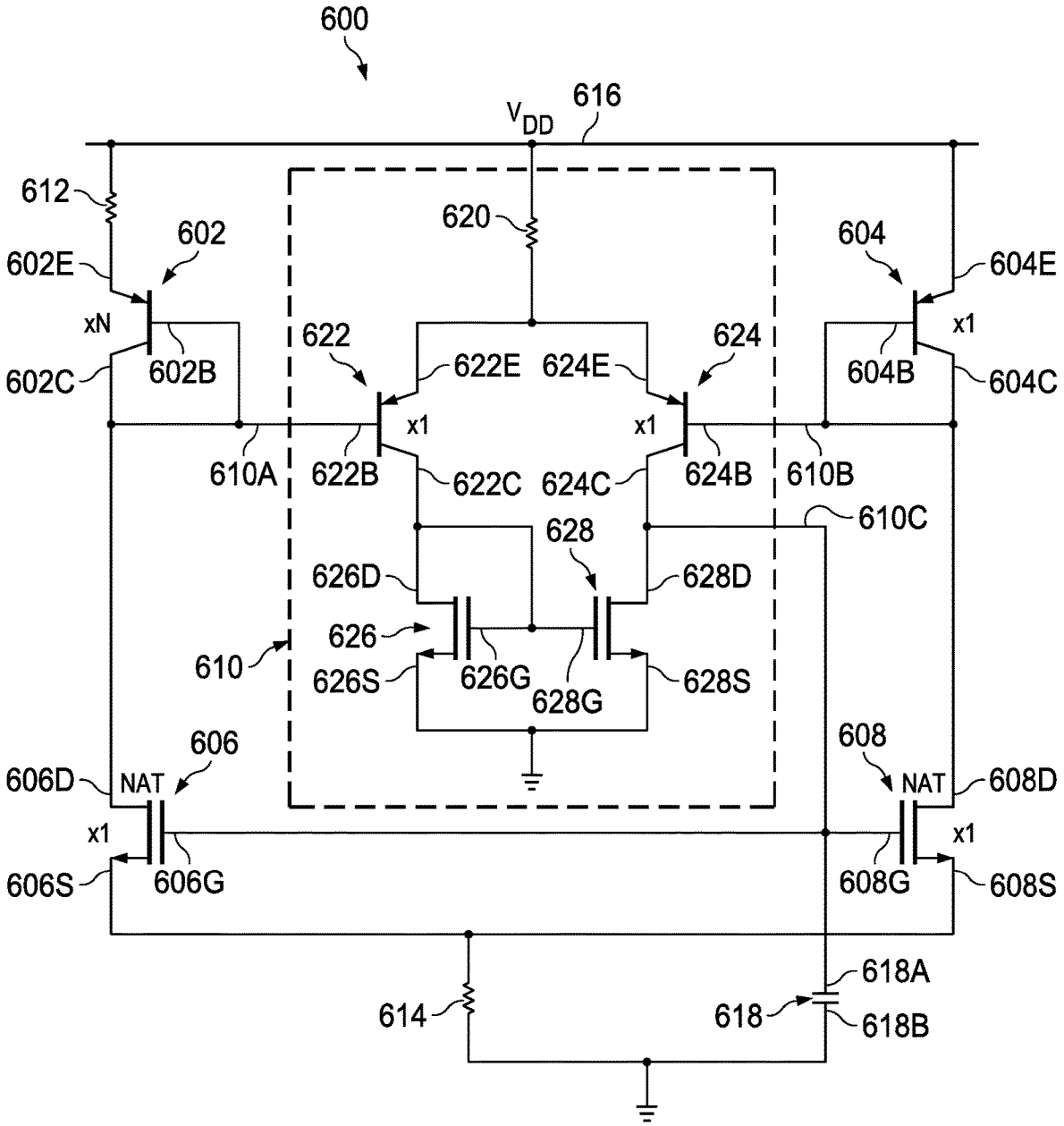

FIG. 6 shows a current reference circuit 600 that includes native transistor current mirrors and a negative feedback amplifier to generate a reference current. The current reference circuit 600 is an implementation of the current reference circuit 300 that includes bipolar transistors. The current reference circuit 600 includes transistors 602-608, an amplifier circuit 610, resistors 612 and 614, and capacitor 618. The transistor 602 and the transistor 604 are PNP bipolar junction transistors, and the transistor 606 and the transistor 608 are N-channel native MOSFETs. The transistor 602 may be larger (N times larger) than the transistor 604. The amplifier circuit 610 applies feedback from the drain of the native MOSFET 608 to control the native MOSFET 606 and the native MOSFET 608. When power is applied to the current reference circuit 600, the power supply rail 616 rises, and the drain current of the native MOSFET 606 rises causing the current reference circuit 600 to settle in the on state. The reference current generated by the current reference circuit 600 flows through the native MOSFET 608.

The native MOSFET 608 includes a source terminal 608S that is coupled to the source terminal 606S of the native MOSFET 606, and to the resistor 614. The gate terminal 608G of the native MOSFET 608 is coupled to the gate terminal 606G of the native MOSFET 606 and the output terminal 610C of the amplifier circuit 610. The drain terminal 608D of the native MOSFET 608 is coupled to the collector terminal 604C of the transistor 604, and to the input terminal 610B of the amplifier circuit 610. The drain terminal 606D of the native MOSFET 606 is coupled to the collector terminal 602C of the transistor 602, and to the input terminal 610A of the amplifier circuit 610.

The transistor 604 is connected as a diode, with the base terminal 604B coupled to the collector terminal 604C. The emitter terminal 604E of the transistor 604 is coupled to the power supply rail 616. The transistor 602 is also connected as a diode, with the base terminal 602B coupled to the collector terminal 602C. The emitter terminal 602E of the transistor 602 is coupled to the power supply rail 616 via the resistor 612. The capacitor 618 is a compensation capacitor that includes a terminal 618A coupled to the output terminal 610C of the amplifier circuit 610, and a terminal 618B coupled to ground.

The amplifier circuit 610 is an implementation of the amplifier circuit 310. The amplifier circuit 610 includes a transistor 622, a transistor 624, a transistor 626, a transistor 628, and a resistor 620. The transistor 622 and the transistor 624 are PNP bipolar transistors, and the transistor 626 and the transistor 628 are N-channel MOSFETs. The transistor 622 includes an emitter terminal 622E that is coupled to the emitter terminal 624E of the transistor 624, and to the power supply rail 616 via the resistor 620. The base terminal 622B of the transistor 622 serves as the input terminal 610A of the amplifier circuit 610. The collector terminal 622C of the transistor 622 is coupled to the drain terminal 626D of the transistor 626. The transistor 626 is connected as a diode, with the drain terminal 626D coupled to the gate terminal 626G. The source terminal 626S of the transistor 626 is coupled to ground.

The base terminal 624B of the transistor 624 serves as the input terminal 610B of the amplifier circuit 610. The collector terminal 624C of the transistor 624 is coupled to the drain terminal 628D of the transistor 628. The drain terminal 628D serves as the output terminal 610C of the amplifier circuit 610. The gate terminal 628G is coupled to the gate terminal 626G of the transistor 626, and the source terminal 628S of the transistor 628 is coupled to ground.

Figure 7:
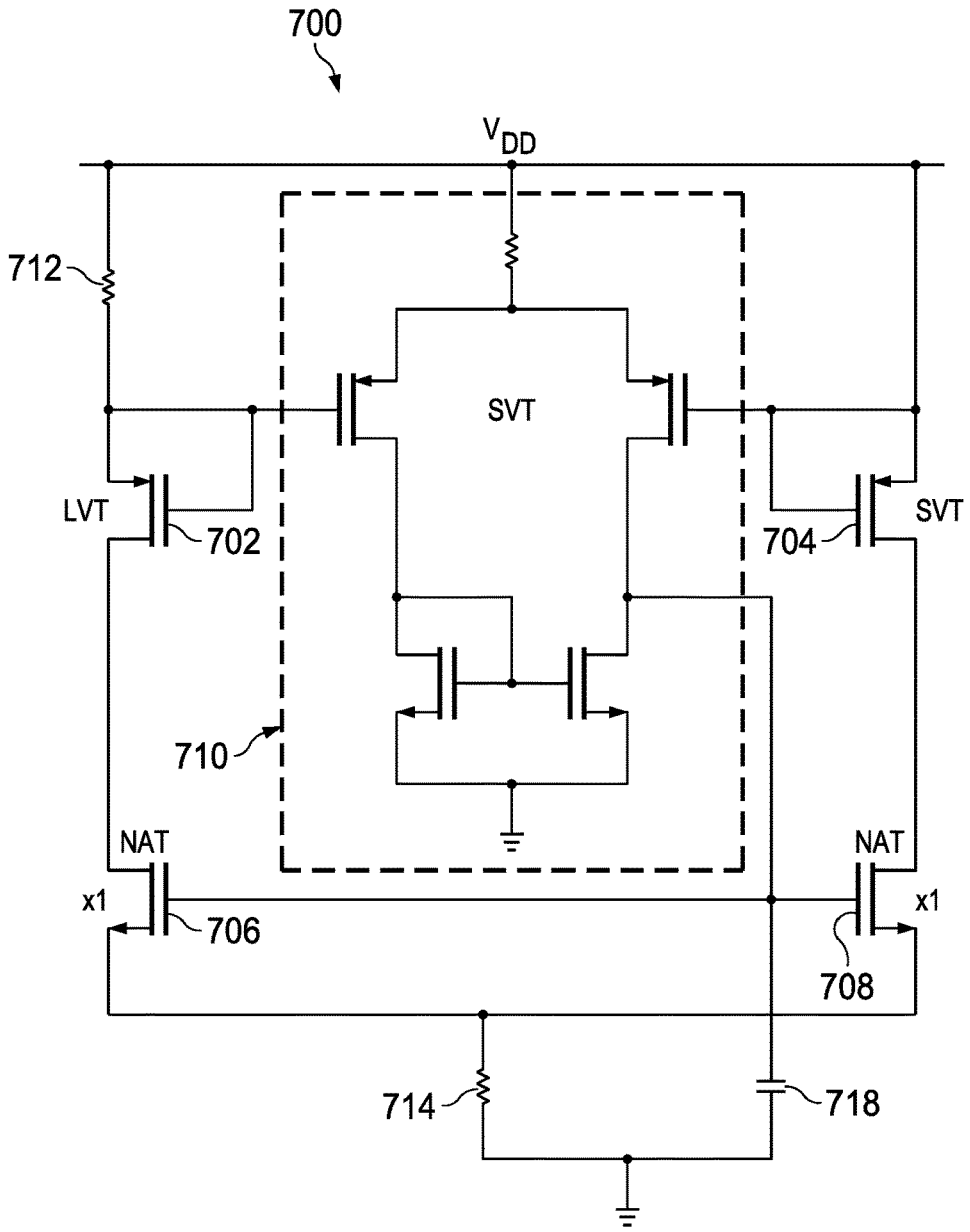

FIG. 7 shows a current reference circuit 700 that includes native transistor current mirrors and a negative feedback amplifier to generate a reference current. The current reference circuit 700 is an implementation of the current reference circuit 300. The current reference circuit 700 includes transistors 702-708, an amplifier circuit 710, resistors 712 and 714, and capacitor 718. The transistor 704 has a standard (e.g., 0.7 volt) threshold. The transistor 702 has a low (e.g., 0.3 volt) threshold. The transistor 706 and the transistor 708 are N-channel native MOSFETs. With the exception of the transistor 702 being a low threshold voltage transistor, the current reference circuit 700 is structurally similar to the current reference circuit 400. The reference current generated by the current reference circuit 700 is defined as:

$$I_{REF} = \Delta V_{th_SVT-LVT} + \frac{mV_T \ln\left(\frac{\beta_{LVT}}{\beta_{SVT}}\right)}{R}$$

Figure 8:
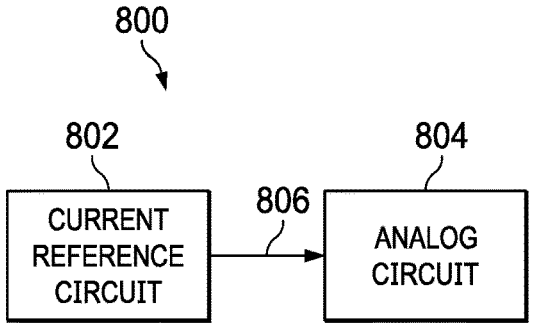
FIG. 8 shows a block diagram for system that includes a current reference circuit in accordance with this description.

FIG. 8 shows a block diagram for system 800 that includes a current reference circuit in accordance with this description. The system 800 may be a low power system, such as a battery powered system. The system 800 includes a current reference circuit 802 and an analog circuit 804. The current reference circuit 802 is an implementation of the current reference circuit 300. For example, the current reference circuit 802 may be an implementation of the current reference circuit 400, the current reference circuit 500, the current reference circuit 600, or the current reference circuit 700. The analog circuit 804 generates a reference current 806 that is provided to the analog circuit 804. The analog circuit 804 may be an amplifier circuit, an oscillator circuit, or other analog circuit that applies the reference current 806.

Figure 9:
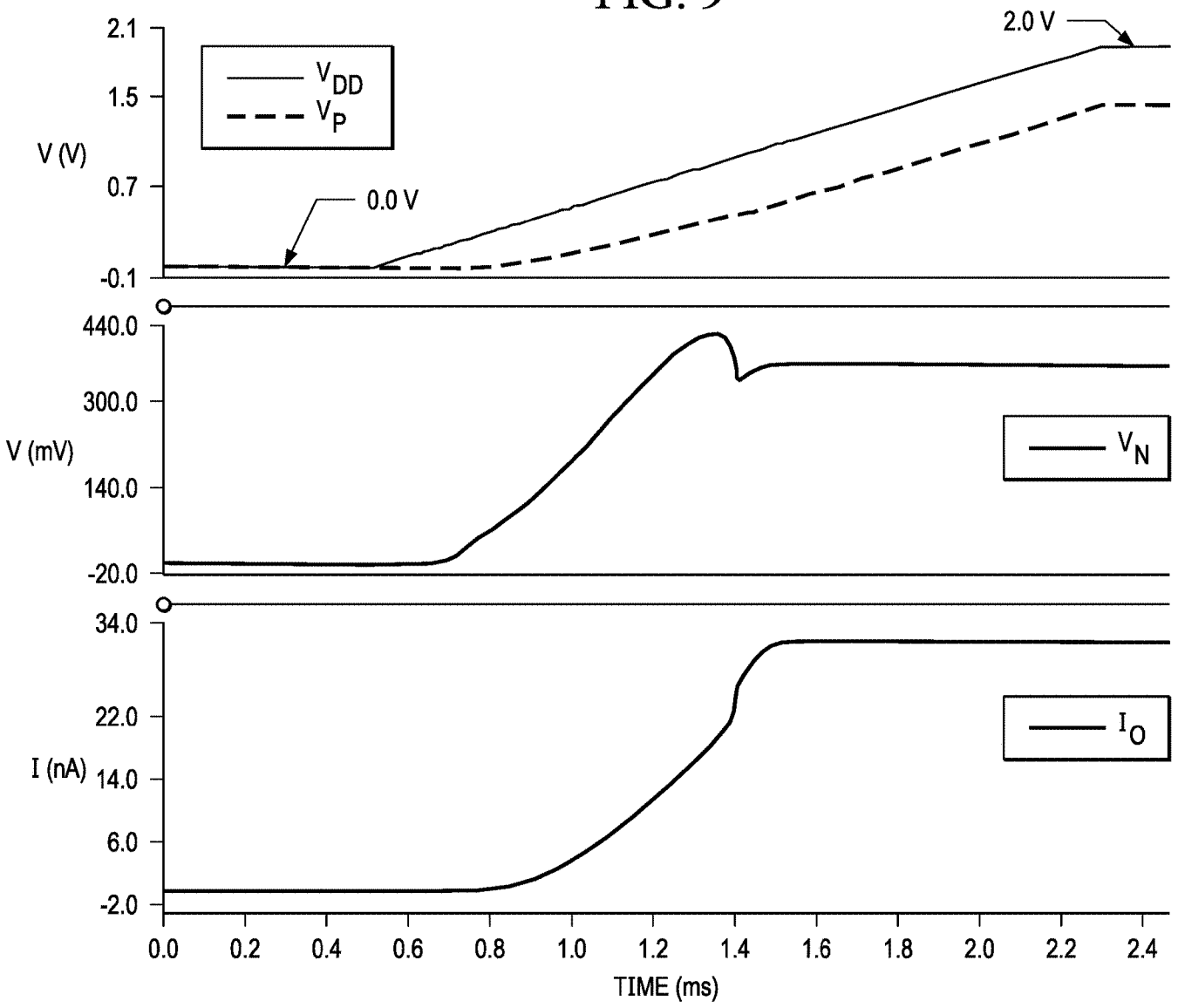
FIG. 9 shows signals generated in a current reference circuit in accordance with this description.

FIG. 9 shows signals generated in a current reference circuit in accordance with this description. The signals of FIG. 9 are referenced to the current reference circuit 400. Initially, the power supply voltage (VDD) and all nodes of the current reference circuit 400, including VP and VN are at zero volts. As VDD increases and exceeds the threshold voltage of the transistors (P-channel MOSFETs) 402 and 404, the native MOSFETs 406 and 408 start to sink current in the presence of non-zero drain-source voltage, and the reference current ($I_O$) increases.

With finite current flowing through the transistors 402 and 404, finite current also flows in the amplifier circuit 410 because the current flowing in the amplifier circuit 410 is a mirror of the current flowing in the transistor 402 and 404 degenerated by the resistor 420. Negative feedback ensures that the input terminals 410A and 410B of the amplifier circuit 410 are the same voltage, thus making the current reference circuit 410 a beta multiplier current reference.

$V_P$ continues to rise as $V_P = V_{DD} - V_{GS_PMOS}$, and the reference current ($I_O$) settles to the $$\frac{\Delta V_{GS}}{R}$$

value when $V_{DD}$ rises sufficiently (e.g., when $VDD = I_O R + 100\ mv + V_{GS_PMOS}$).

Modifications are possible in the described embodiments, and other embodiments are possible, within the scope of the claims.

What is claimed is:

1. A current reference circuit, comprising:

a power supply terminal and a ground terminal;

a first resistor having one terminal connected to the power supply terminal and having another terminal;

a first transistor having a first terminal connected to the another terminal of the resistor, having a second terminal, having a control terminal connected to the second terminal of the first transistor, and having a first, standard threshold voltage;

a second transistor having a first terminal connected to the power supply terminal, having a second terminal, having a control terminal connected to the second terminal of the second transistor, and having a second, standard threshold voltage, the second transistor being N times larger than the first transistor;

an amplifier circuit having a non-inverting input connected to the second terminal of the first transistor, having an inverting input connected to the second terminal of the second transistor, and having an amplifier output;

a third transistor having a first terminal connected to the second terminal of the first transistor, having a second terminal, and having a control terminal connected the amplifier output, the third transistor having a third threshold voltage lower than the standard threshold voltage;

a fourth transistor having a first terminal connected to the second terminal of the second transistor, having a second terminal coupled to the second terminal of the third transistor, and having a control terminal connected to the amplifier output, the fourth transistor having a fourth threshold voltage lower than the standard threshold voltage; and a second resistor having one terminal connected to the second terminals of the third and fourth transistors and having another terminal connected to the ground terminal.

2. The current reference circuit of claim 1, including a capacitor having:

a first terminal coupled to the amplifier output; and a second terminal coupled to the ground terminal.

3. The current reference circuit of claim 1 in which the first, second, third, and fourth transistors are field effect transistors.

4. The current reference circuit of claim 1 in which the third and fourth transistors are N-channel native transistors.

5. The current reference circuit of claim 1 in which the first and second transistors are P-channel field effect transistors.

6. The current reference circuit of claim 1, in which the first and second standard threshold voltages are 0.7 volts and the third and fourth threshold voltages are zero volts.

7. The current reference circuit of claim 6, in which the third and fourth transistors are natural transistors.

8. The current reference circuit of claim 6, in which the amplifier circuit includes:

a first resistor having one terminal connected to the power supply terminal and having another terminal;

a first amplifier transistor having a first terminal connected to the another terminal, having a control terminal connected to the second terminal of the first transistor, and having a second terminal;

a second amplifier transistor having a first terminal connected to the other terminal, having a control terminal connected to the second terminal of the second transistor, and having a second terminal connected to the amplifier output;

a third amplifier transistor having a first terminal connected to the second terminal of the first amplifier transistor, having a control terminal connected to the first terminal of the third amplifier transistor, and having a second terminal; and a fourth amplifier transistor having a first terminal connected to the amplifier output, having a control terminal connected to the control input of the third amplifier transistor, and having a second terminal connected to the second terminal of the third amplifier transistor; and a second resistor having one terminal connected to the second terminals of the third and fourth amplifier transistors and having another terminal connected to the ground terminal.

9. The current reference circuit of claim 8, in which the amplifier circuit includes:

a fifth amplifier transistor having a first terminal connected to the second terminal of the first amplifier transistor, having a control terminal connected to the control terminal of the first amplifier transistor, and having a second terminal connected to the first terminal of the third amplifier transistor; and a sixth amplifier transistor having a first terminal connected to the second terminal of the second amplifier transistor, having a control terminal connected to the control terminal of the second amplifier transistor, and having a second terminal connected to the first terminal of the fourth amplifier transistor.

10. The current reference circuit of claim 8, including a capacitor having:

a first terminal coupled to the amplifier output; and a second terminal coupled to the ground terminal.

11. A current reference circuit comprising:

a power supply terminal and a ground terminal;

a first resistor having one terminal connected to the power supply terminal and having another terminal;

a first transistor having a first terminal connected to the another terminal, having a control terminal connected to the first terminal of the first transistor, having a second terminal, and having a low threshold voltage;

a second transistor having a first terminal connected to the power supply terminal, having a control terminal connected to the first terminal of the second transistor, having a second terminal, and having a standard threshold voltage;

a third transistor having a first terminal connected to the second terminal of the first transistor, having a second terminal, and having a control terminal, the third transistor having a threshold voltage lower than the standard threshold voltage;

a fourth transistor having a first terminal connected to the second terminal of the second transistor, having a second terminal coupled to the second terminal of the third transistor, and having a control terminal connected to control terminal of the third transistor, the fourth transistor having a threshold voltage lower than the standard threshold voltage;

a second resistor having one terminal connected to the second terminals of the third and fourth transistors and having another terminal connected to the ground terminal;

a first capacitor having one terminal connected to the control terminals of the third and fourth transistors and having another terminal connected to the ground terminal;

a third resistor having one terminal connected to the power supply terminal and having another terminal;

a first amplifier transistor having a first terminal connected to the another terminal of the third resistor, having a control terminal connected to the another terminal of the first resistor, and having a second terminal;

a second amplifier transistor having a first terminal connected to the another terminal of the third resistor, having a control terminal connected to the power supply terminal, and having a second terminal connected to the control terminals of the third and fourth transistors;

a third amplifier transistor having a first terminal connected to the second terminal of the first amplifier transistor, having a control terminal connected to the second terminal of the first amplifier transistor, and having a second terminal connected to the ground terminal; and a fourth amplifier transistor having a first terminal connected to the second terminal of the second amplifier transistor, having a control terminal connected to the control terminal of the third amplifier transistor, and having a second terminal connected to the ground terminal.

12. The current reference circuit of claim 11 in which the first, second, third, and fourth transistors are field effect transistors.

13. The current reference circuit of claim 11 in which the first amplifier, second amplifier, third amplifier, and fourth amplifier transistors are field effect transistors.

14. The current reference circuit of claim 11 in which the third and fourth transistors are N-channel native transistors.

15. The current reference circuit of claim 11 in which the first and second transistors are P-channel field effect transistors.

* * * * *